US011359506B2

(12) United States Patent
McCaffrey

(10) Patent No.: US 11,359,506 B2
(45) Date of Patent: Jun. 14, 2022

(54) CONTOURED STOP FOR VARIABLE AREA TURBINE

(71) Applicant: United Technologies Corporation, Farmington, CT (US)

(72) Inventor: Michael G. McCaffrey, Windsor, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 94 days.

(21) Appl. No.: 16/740,645

(22) Filed: Jan. 13, 2020

(65) Prior Publication Data

US 2021/0215057 A1 Jul. 15, 2021

(51) Int. Cl.

| | |
|---|---|
| ***F01D 9/02*** | (2006.01) |
| ***F01D 9/04*** | (2006.01) |
| ***F01D 11/08*** | (2006.01) |
| ***F01D 17/16*** | (2006.01) |

(52) U.S. Cl.

CPC ..... *F01D 11/08* (2013.01); *F01D 9/02* (2013.01); *F01D 9/04* (2013.01); *F01D 9/041* (2013.01); *F01D 17/162* (2013.01); *F05D 2220/32* (2013.01); *F05D 2240/12* (2013.01); *F05D 2240/55* (2013.01)

(58) Field of Classification Search

CPC . F01D 9/02; F01D 9/04; F01D 17/162; F01D 9/041; F05D 2240/12

See application file for complete search history.

(56) References Cited

U.S. PATENT DOCUMENTS

| | | | | |
|---|---|---|---|---|
| 2,603,300 | A * | 7/1952 | King | F03D 3/068 416/10 |
| 3,790,298 | A * | 2/1974 | Hendrickson | F01D 5/147 415/153.2 |
| 4,693,073 | A | 9/1987 | Blackburn | |
| 5,146,752 | A | 9/1992 | Bruestle | |
| 7,412,830 | B2 * | 8/2008 | Sumser | F02B 37/225 60/605.1 |
| 8,070,425 | B2 * | 12/2011 | Roberts | F02C 6/12 415/157 |
| 8,105,019 | B2 * | 1/2012 | McCaffrey | F01D 17/162 415/160 |

(Continued)

FOREIGN PATENT DOCUMENTS

| | | |
|---|---|---|
| EP | 0433560 A1 | 6/1991 |
| EP | 2105583 A2 | 9/2009 |

(Continued)

OTHER PUBLICATIONS

EP Search Report dated Apr. 6, 2021 issued for corresponding European Patent Application No. 21151445.0.

*Primary Examiner* — Michael Lebentritt
*Assistant Examiner* — Brian Christopher Delrue
(74) *Attorney, Agent, or Firm* — Bachman & LaPointe, P.C.

(57) ABSTRACT

A vane ring for a gas turbine engine includes a contoured stop that extends from the static flowpath wall, the contoured stop being of an airfoil shape such that a first side of the contoured stop matches a portion of a first side of the first variable vane along a chord length when the first variable vane is pivoted about the longitudinal axis to a first position.

24 Claims, 6 Drawing Sheets

(56) References Cited

U.S. PATENT DOCUMENTS

| | | | | |
|---|---|---|---|---|
| 8,123,471 | B2 * | 2/2012 | Mielke | F01D 17/162 415/160 |
| 9,028,202 | B2 * | 5/2015 | Yokoyama | F01D 17/165 415/163 |
| 9,533,485 | B2 * | 1/2017 | Marshall | F01D 17/162 |
| 9,638,212 | B2 | 5/2017 | Marshall | |
| 10,060,444 | B2 | 8/2018 | Marshall et al. | |
| 10,151,210 | B2 * | 12/2018 | Thomas | F04D 29/544 |
| 10,233,769 | B2 | 3/2019 | Scothem | |

FOREIGN PATENT DOCUMENTS

| | | | |
|---|---|---|---|
| EP | 2975224 | A1 | 1/2016 |
| JP | S63183206 | A | 7/1988 |
| JP | 2010096018 | A | 4/2010 |

* cited by examiner

CONTOURED STOP FOR VARIABLE AREA TURBINE

BACKGROUND

The present disclosure relates to a gas turbine engine and, more particularly, to modulated variable area turbine nozzles.

Gas turbine engines, such as those that power modern commercial and military aircraft, generally include a compressor section to pressurize an airflow, a combustor section to burn a hydrocarbon fuel in the presence of the pressurized air, and a turbine section to extract energy from the resultant combustion gases.

Typical turbine sections, such as high pressure and low pressure turbine nozzles, have fixed nozzle throat areas in view of the severe temperature and high pressure loading environment in which they operate. The throat areas between adjacent nozzle vanes must be accurately maintained for maximizing performance of the engine.

Some gas turbine engines include Variable-Area-Turbine (VAT) designs that adjust the geometry of the vanes during various flight phases to maximize performance and efficiency over various flight conditions. Variable-Area-Turbine (VAT) designs are complicated both in mechanical implementation as well as in aerodynamic performance. The pivotable nozzle vanes may result in hub and tip gaps which require suitable sealing since leakage of the combustion gases may adversely affect performance and efficiency to an extent which may negate the effectiveness of the variability being introduced.

SUMMARY

A vane ring for a gas turbine engine according to one disclosed non-limiting embodiment of the present disclosure includes an outer static flowpath wall defined around an axis; an inner static flowpath wall defined around the axis; a multiple of variable vanes that extend between the outer static flowpath wall and the inner static flowpath wall, each of the multiple of variable vanes pivotable about a respective longitudinal axis; and a multiple of contoured stops that extend from at least one of the outer static flowpath wall and the inner static flowpath wall, each one of the multiple of contoured stops located adjacent to each of the multiple of variable vanes to seal with each respective one of the multiple of variable vanes when the respective variable vane is pivoted about the longitudinal axis to a first position.

A further embodiment of any of the foregoing embodiments of the present disclosure includes that the first position is an open condition for the vane ring.

A further embodiment of any of the foregoing embodiments of the present disclosure includes a multiple of non-pivotable vanes that alternate with the multiple of variable vanes.

A further embodiment of any of the foregoing embodiments of the present disclosure includes that each of the multiple of contoured stops are airfoil shaped.

A further embodiment of any of the foregoing embodiments of the present disclosure includes that each of the multiple of contoured stops extend for a chord length between 20%-40% of a chord length of each of the multiple of variable vanes.

A further embodiment of any of the foregoing embodiments of the present disclosure includes that each of the multiple of contoured stops extend for a height of between 2%-7% of a span of each of the multiple of variable vanes.

A further embodiment of any of the foregoing embodiments of the present disclosure includes that each of the multiple of contoured stops are blended into at least one of the outer static flowpath wall and the inner static flowpath wall.

A further embodiment of any of the foregoing embodiments of the present disclosure includes that the first position is an open condition for the vane ring.

A variable area turbine for a gas turbine engine according to one disclosed non-limiting embodiment of the present disclosure includes a static flowpath wall defined around an axis; a first variable vane that extends from the static flowpath wall, the first variable vane pivotable about a longitudinal axis; and a contoured stop that extends from the static flowpath wall, the contoured stop being of an airfoil shape such that a first side of the contoured stop matches a portion of a first side of the first variable vane along a chord length when the first variable vane is pivoted about the longitudinal axis to a first position.

A further embodiment of any of the foregoing embodiments of the present disclosure includes that the static flowpath wall is at least one of an outer static flowpath wall and an inner static flowpath wall of a turbine vane ring.

A further embodiment of any of the foregoing embodiments of the present disclosure includes that the contoured stop extends for a chord length between 20%-40% of a chord length of each of the multiple of variable vanes.

A further embodiment of any of the foregoing embodiments of the present disclosure includes that the contoured stop extends for a height of between 2%-7% of a span of each of the multiple of variable vanes.

A further embodiment of any of the foregoing embodiments of the present disclosure includes that the first side of the contoured stop is of a convex shape and the first side of the vane is a concave shape A further embodiment of any of the foregoing embodiments of the present disclosure includes that the first side of the contoured stop is of a concave shape and the first side of the vane is a convex shape.

A further embodiment of any of the foregoing embodiments of the present disclosure includes a second vane that extends from the static flowpath wall, the first variable vane pivotable about the longitudinal axis with respect to the second vane to define a throat therebetween.

A method of operating a variable area turbine, according to one disclosed non-limiting embodiment of the present disclosure includes rotating a variable vane about a longitudinal axis until a side of the variable vane contacts a contoured stop that extends from a static flowpath wall, the contoured stop of a shape that matches at least a portion of the side of the vane providing a sealing surface therewith.

A further embodiment of any of the foregoing embodiments of the present disclosure includes that rotating the vane comprises rotating the vane such that a convex side of the vane seals with a concave side of the contoured stop.

A further embodiment of any of the foregoing embodiments of the present disclosure includes that rotating the vane comprises rotating the vane such that a concave side of the vane seals with a convex side of the contoured stop.

A further embodiment of any of the foregoing embodiments of the present disclosure includes that the sealing surface is a chord length between 20%-40% of a chord length the variable vane.

A further embodiment of any of the foregoing embodiments of the present disclosure includes that the sealing surface extends from the static flowpath wall for a height of between 2%-7% of a span of each of the vanes.

The foregoing features and elements may be combined in various combinations without exclusivity, unless expressly indicated otherwise. These features and elements as well as the operation thereof will become more apparent in light of the following description and the accompanying drawings. It should be appreciated; however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
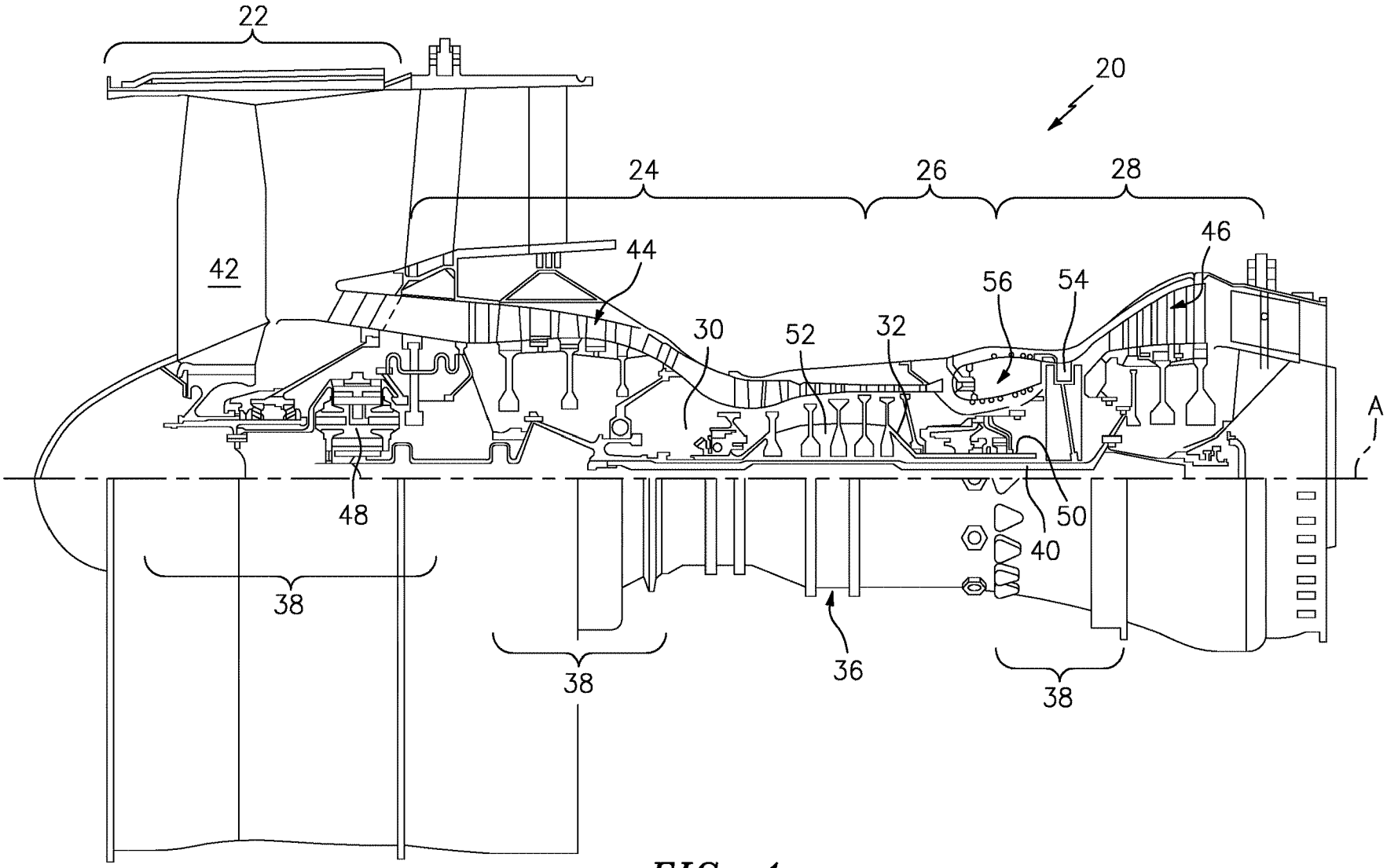
FIG. 1 is a schematic cross-section of an example gas turbine engine architecture.

FIG. 1 schematically illustrates a gas turbine engine 20. The gas turbine engine 20 is disclosed herein as a two-spool geared turbofan ("GTF") that generally incorporates a fan section 22, a compressor section 24, a combustor section 26 and a turbine section 28. The fan section 22 drives air along a bypass flowpath while the compressor section 24 drives air along a core flowpath for compression and communication into the combustor section 26 then expansion thru the turbine section 28. Although depicted as a GTF in the disclosed non-limiting embodiment, it should be understood that the concepts described herein are not limited to use with GTF as the teachings may be applied to other types of turbine engines such as a Direct-Drive-Turbofan with high, or low bypass turbofan, turbojets, turboshafts, and three-spool (plus fan) turbofans wherein an intermediate spool includes an intermediate pressure compressor ("IPC") between a low pressure compressor ("LPC") and a high pressure compressor ("HPC"), and an intermediate pressure turbine ("IPT") between the high pressure turbine ("HPT") and the low pressure turbine ("LPT").

The engine 20 generally includes a low spool 30 and a high spool 32 mounted for rotation about an engine central longitudinal axis A relative to an engine static structure 36 via several bearing compartments 38. The low spool 30 generally includes an inner shaft 40 that interconnects a fan 42, LPC 44 and LPT 46. The inner shaft 40 drives the fan 42 directly or thru a geared architecture 48 to drive the fan 42 at a lower speed than the low spool 30. An exemplary reduction transmission is an epicyclic transmission, namely a planetary or star gear system.

The high spool 32 includes an outer shaft 50 that interconnects HPC 52 and HPT 54. A combustor 56 is arranged between the HPC 52 and the HPT 54. The inner shaft 40 and the outer shaft 50 are concentric and rotate about the engine central longitudinal axis A which is collinear with their longitudinal axes.

Core airflow is compressed by the LPC 44 then the HPC 52, mixed with fuel and burned in the combustor 56, then expanded over the HPT 54 and the LPT 46. The turbines 54, 46 rotationally drive the respective low spool 30 and high spool 32 in response to the expansion. The main engine shafts 40, 50 are supported at a plurality of points by the bearing compartments 38. It should be understood that various bearing compartments 38 at various locations may alternatively or additionally be provided.

In one example, the gas turbine engine 20 is a high-bypass geared aircraft engine with a bypass ratio greater than about six (6:1). The geared architecture 48 can include an epicyclic gear train, such as a planetary gear system or other gear system. The example epicyclic gear train has a gear reduction ratio of greater than about 2.3:1, and in another example is greater than about 3.0:1. The geared turbofan enables operation of the low spool 30 at higher speeds which can increase the operational efficiency of the LPC 44 and LPT 46 to render increased pressure in relatively few stages.

A pressure ratio associated with the LPT 46 is pressure measured prior to the inlet of the LPT 46 as related to the pressure at the outlet of the LPT 46 prior to an exhaust nozzle of the gas turbine engine 20. In one non-limiting embodiment, the bypass ratio of the gas turbine engine 20 is greater than about ten (10:1), the fan diameter is significantly larger than that of the LPC 44, and the LPT 46 has a pressure ratio that is greater than about five (5:1). It should be understood, however, that the above parameters are only exemplary of one embodiment of a geared architecture engine and that the present disclosure is applicable to other gas turbine engines including direct drive turbofans, where the rotational speed of the fan 42 is the same (1:1) of the LPC 44.

In one example, a significant amount of thrust is provided by the bypass flow path due to the high bypass ratio. The fan section 22 of the gas turbine engine 20 is designed for a particular flight condition—typically cruise at about 0.8 Mach and about 35,000 feet (10668 meters). This flight condition, with the gas turbine engine 20 at its best fuel consumption, is also known as bucket cruise thrust specific fuel consumption ("TSFC"). TSFC is an industry standard parameter of fuel consumption per unit of thrust.

Fan pressure ratio is the pressure ratio across a blade of the fan section 22 without the use of a fan exit guide vane system. The relatively low fan pressure ratio according to one example gas turbine engine 20 is less than 1.45. Low corrected fan tip speed is the actual fan tip speed divided by an industry standard temperature correction of $(\text{"T"}/518.7)^{0.5}$ in which "T" represents the ambient temperature in degrees Rankine. The low corrected fan tip speed according to one example gas turbine engine 20 is less than about 1150 fps (351 m/s).

Figure 2:
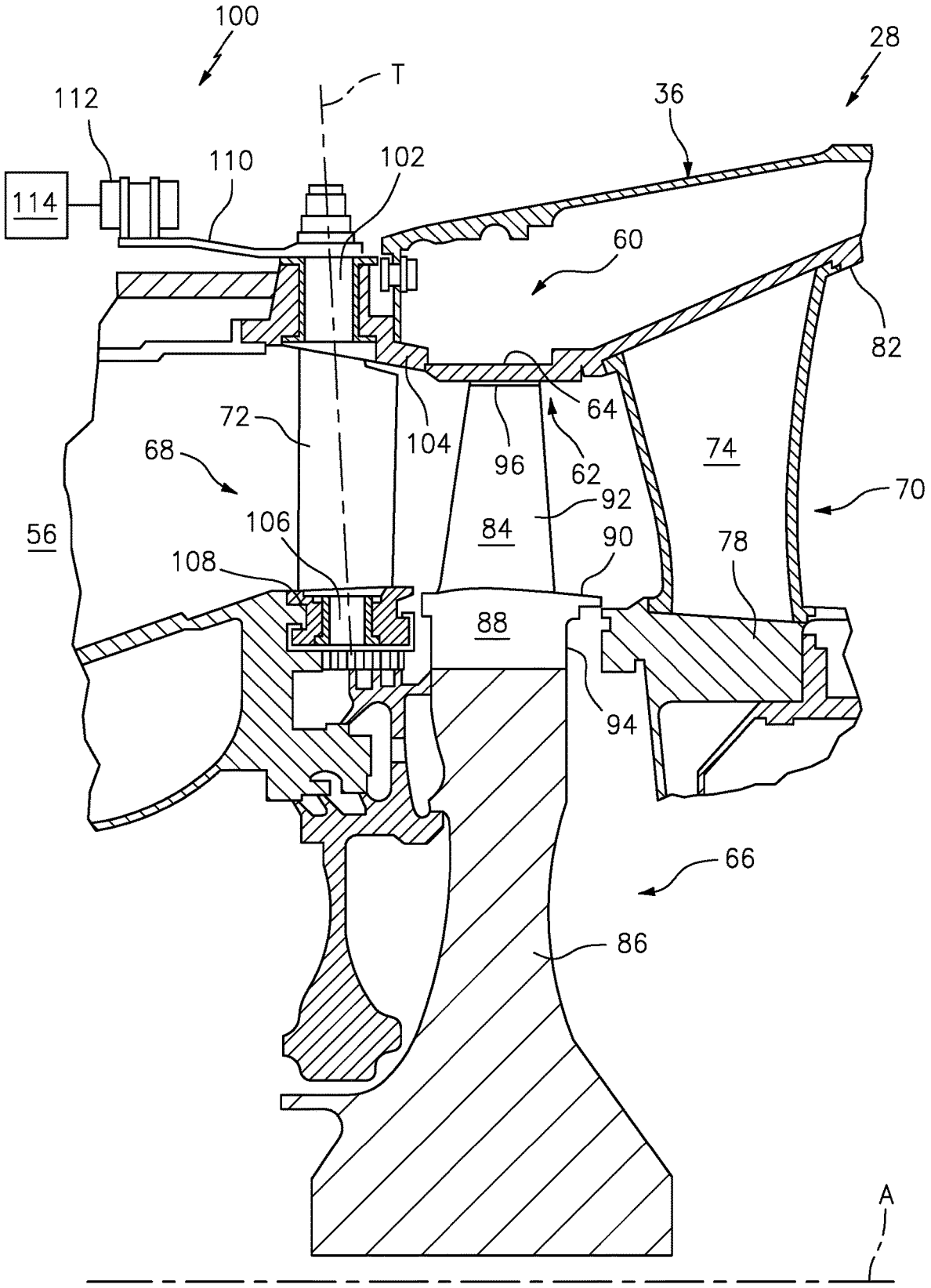
FIG. 2 is a schematic view of a variable area turbine system for a gas turbine engine.

With reference to FIG. 2, an enlarged schematic view of a portion of the turbine section 28 is shown by way of example; however, other engine sections such as the compressor and fan section will also benefit herefrom. A static flowpath wall assembly 60 within the engine case structure 36 supports a blade outer air seal ("BOAS") assembly 62 with a multiple of circumferentially distributed BOAS 64 proximate to a rotor assembly 66 (one schematically shown).

Figure 3:
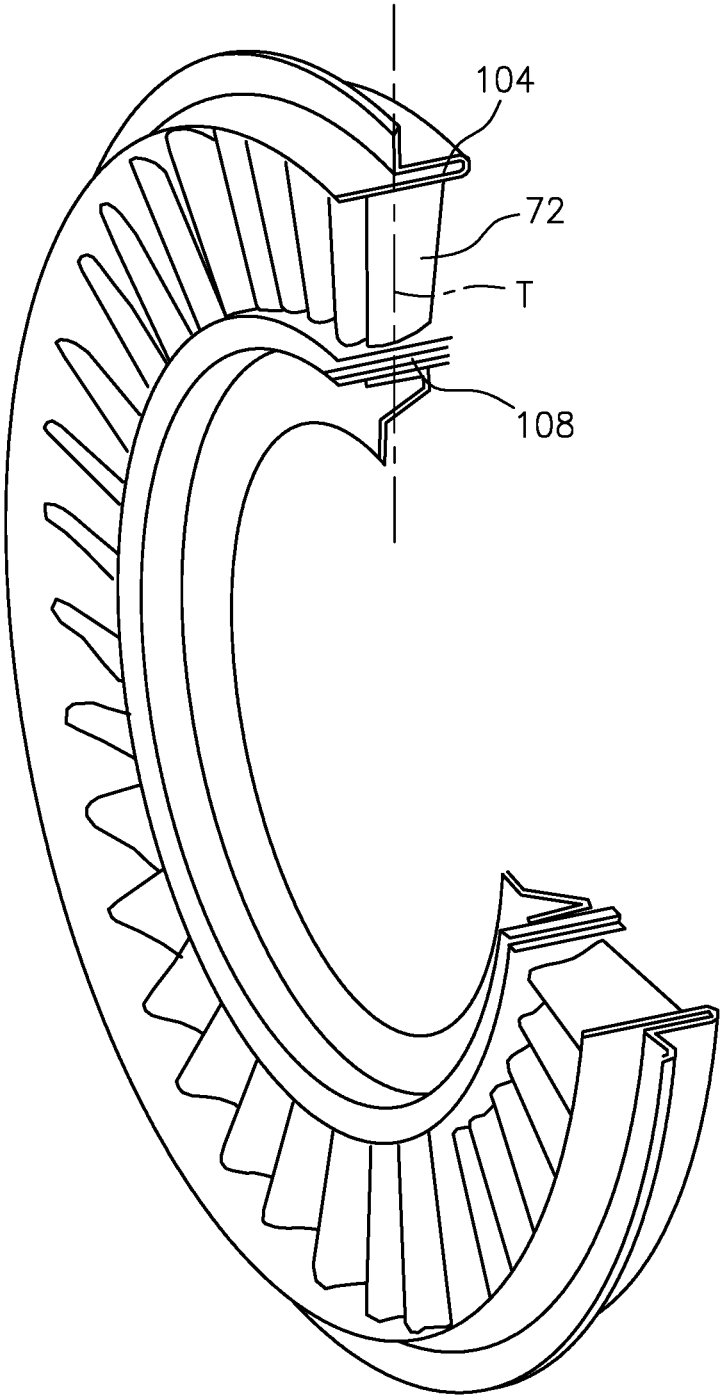
FIG. 3 is a partial perspective view of one stage of a variable area turbine system for a gas turbine engine.

The static flowpath wall assembly 60 and the BOAS assembly 62 are axially disposed between a forward vane ring 68 (also shown in FIG. 3) and an aft vane ring 70. Each vane ring 68, 70 includes an array of vanes 72, 74 that extend between a respective outer static flowpath wall 104 and an inner static flowpath wall 108 that defines the core flow path downstream of the combustor 56.

The rotor assembly 66 includes an array of blades 84 circumferentially disposed around a disk 86. Each blade 84 includes a root 88, a platform 90 and an airfoil 92. The blade roots 88 are received within a rim 94 of the disk 86 and the airfoils 92 extend radially outward such that a tip 96 of each airfoil 92 interfaces with the BOAS assembly 62.

One or more stages of the HPT 54 and/or the LPT 46 may include a variable area turbine system 100 associated with the forward vane ring 68 such that the operational performance characteristic can be adjusted for different operating conditions.

The forward vane ring 68 includes multiple variable stator vanes 72, to which vanes 74 may be similar and to which the following description also may apply, has a longitudinal axis that extends in a radial direction relative to the engine axis. The variable stator vane 72 is supported in the core flow adjacent to the rotor assembly 66 so that it can be pivoted about its longitudinal axis T in order to be angularly adjustable relative to the core airflow stream, to respond to changing engine operating conditions, and thereby to maintain operating efficiency. The variable stator vane 72 includes an outer trunnion 102 that is pivotally received in an outer static flowpath wall 104. The innermost longitudinal end of each variable stator vane 72 includes an inner trunnion 106 that is rotatable received in an inner static flowpath wall 108. The outer trunnion 102 and the inner trunnion 106 may be of diameter smaller than the thickness of the respective stator vane 72 such that the "button" diameter thereof does not extend beyond the airfoil profile.

Connected to the outer trunnion 102 is a vane arm 110 that extends transversely relative to the stator vane longitudinal axis T and that is pivotally received to a synchronizing ring assembly 112. The synchronizing ring assembly 112 to which each of the vane arms 110 are attached, is driven by a suitable actuator 114 to simultaneously pivot each, or any number of the variable vanes of the stage through the same or different pivot angles. Alternately, each variable vane may be actuated independently such that each may be actuated to a specific and different angle.

Figure 4:
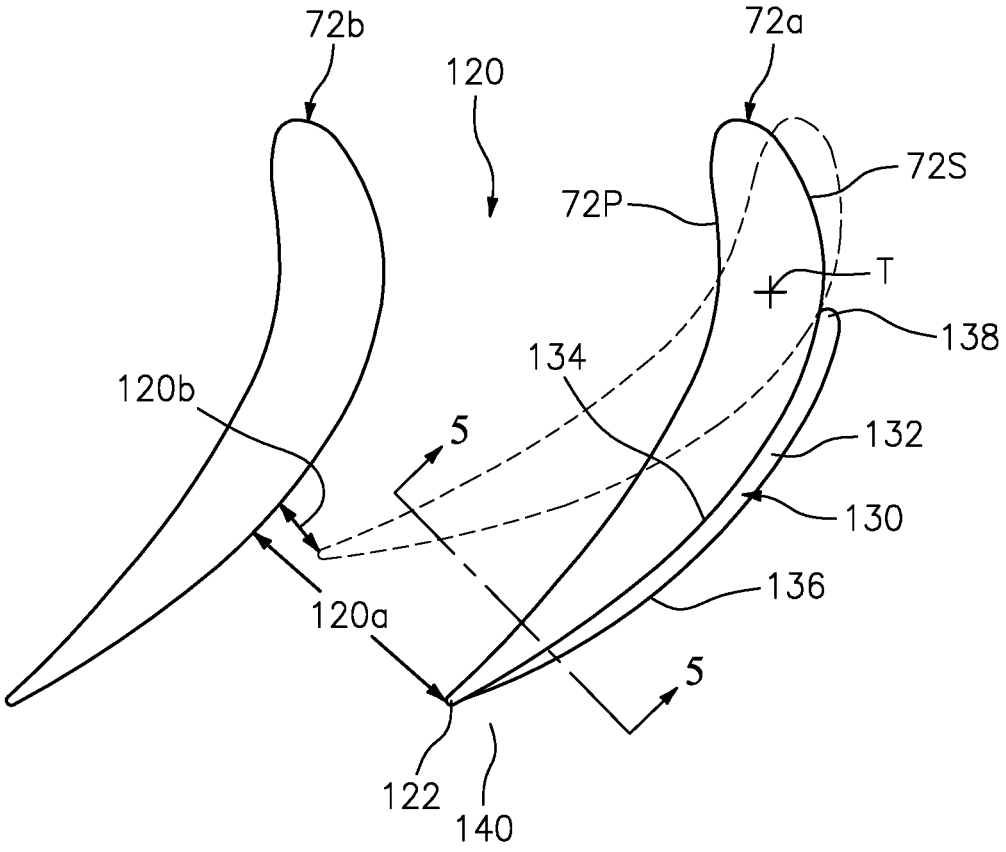
FIG. 4 is a schematic view of a contoured stop for the variable area turbine system according to one disclosed non-limiting embodiment.

With reference to FIG. 4, the arrays of variable vanes 72 define a throat 120 which is the shortest distance between a trailing edge 122 of a first variable vane 72*a* and an adjacent second vane 72*b*. In this embodiment, the first variable vane 72*a* is variable and rotatable about the longitudinal axis T, while vane 72*b* is non-rotational. That is, the multiple of non-pivotable vanes 72B alternate with the multiple of variable vanes 72*a*. Vane 72*a* is rotatable between different positions as illustrated in broken lines in FIG. 4, and rotation of vane 72*a* changes the throat 120 between an open position 120*a* and a closed position 120*b*. In the non-limiting configuration of FIG. 4, every other vane 72*a* is rotatable and is between a respective fixed vane 72*b*, however, other embodiments may provide that every vane is variable. Decreasing the throat 120 reduces the effective flow area between the vanes 72*a*, 72*b* and may therefore provide desirable aerodynamic properties during cruise where lower turbine output is required.

The variable area turbine system 100 may leak between the moving variable vanes 72*a* and the outer static flowpath wall 104 and the inner static flowpath wall 108. The acceleration of the air through the cascade of vanes may causes a low static pressure to develop in the region of highest velocity. This may occur near the throat where the trailing edge of one airfoil is closest to the surface of the adjacent airfoil. Typically, a gap exists in the region of the throat with the disadvantage of the higher static pressure on the pressure side 72P of the airfoil as compared to the suction side 72S at the throat. Leakage occurs from the high static pressure zone to the lower static pressure zone as pressure differentials may be from 200-250 psid (13.8-17.2 bar).

Figure 5:
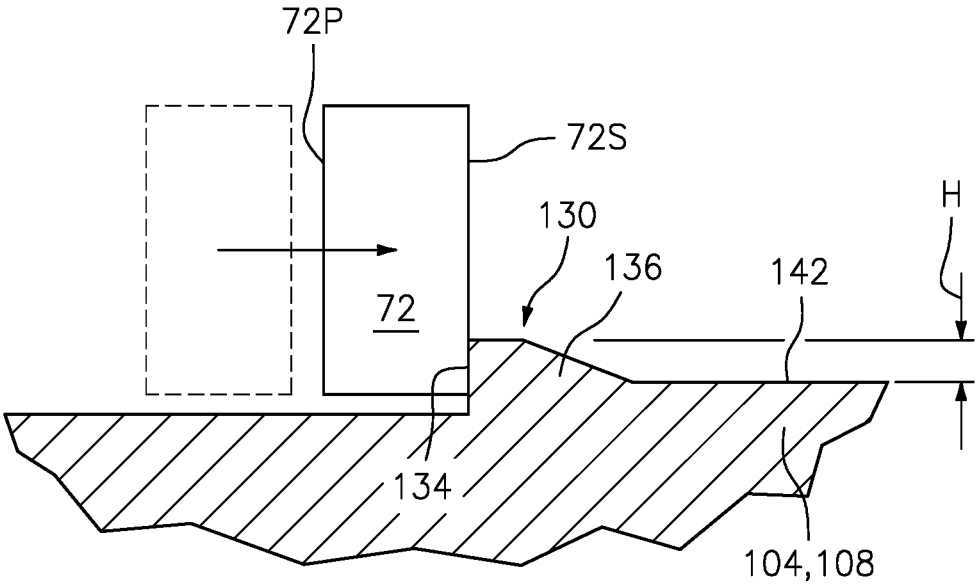
FIG. 5 is a sectional view of the contoured stop for the variable area turbine system according to one disclosed non-limiting embodiment.

A contoured stop 130 (also shown in FIG. 5) extends from an inner surface 142 of either or both of the outer static flowpath wall 104 and the inner static flowpath wall 108. The contoured stop 130 in this embodiment is located adjacent to the suction side 72S of the first variable vane 72*a*. The contoured stop 130 may form a general airfoil shape 132 with a first side 134 that may be concave to define the contoured stop surface that contacts and seals with the convex suction side 72S of the first variable vane 72*a*. A second side 136 that may be convex shaped blends the contoured stop 130 into the inner surface 142 (FIG. 5). The contoured stop 130 may include cooling features such as cooling air impingement passages and the like.

In this embodiment, the leading edge 138 of the contoured stop 130 with respect to the core airflow path direction, is thinner than the trailing edge 140. Each contoured stop 130 may extend for a height H (FIG. 5) of between 2%-7% of a span, and more specifically 3%-4% of the span of the vane 72. A chord length of the contoured stop 130 between the leading edge 138 and the trailing edge 140 thereof defines a chord length between 20%-40% of the chord length of the vanes 72 and more specifically 30%.

Figure 6:
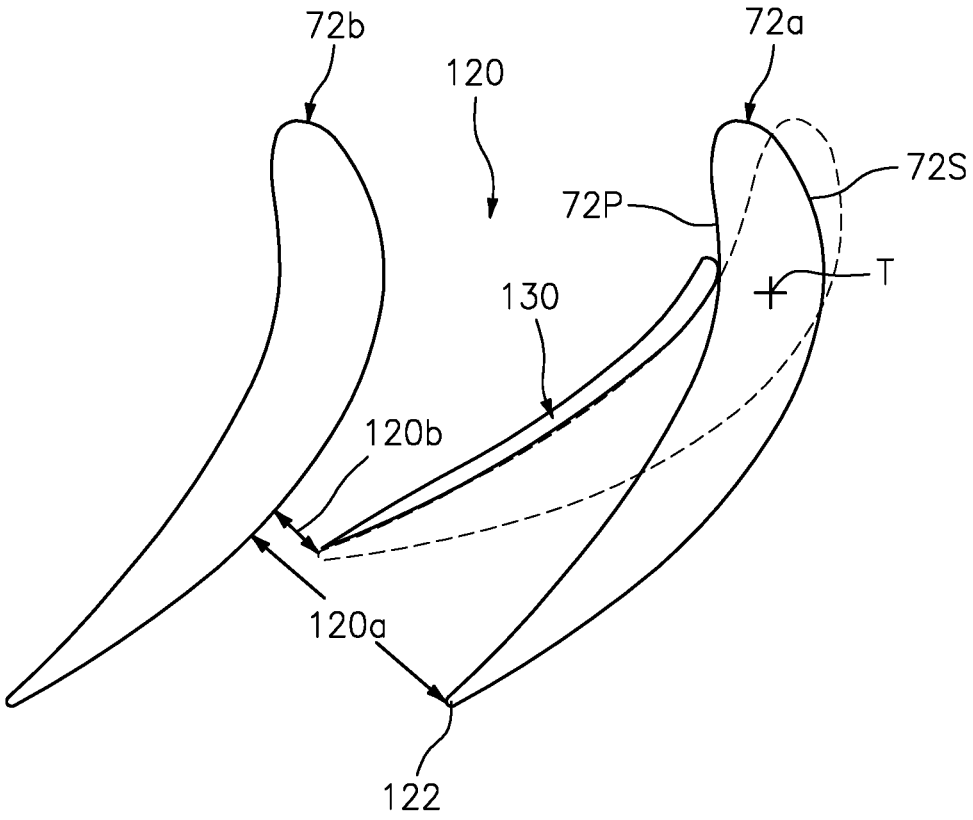
FIG. 6 is a schematic view of a contoured stop for the variable area turbine system according to another disclosed non-limiting embodiment.

With reference to FIG. 6, in another embodiment, the contoured stop 130 is located adjacent to the pressure side 72P of the first variable vane 72*a* within the throat area 120 when in the closed position. In this embodiment, the contoured stop 130 matches the pressure side 72P of the first variable vane 72*a*. The contoured stop 130 may be blended into the inner surface 142 of the respective outer static flowpath wall 104 and/or the inner static flowpath wall 108 with respect to the combustion flow direction.

In operation, the array of vanes 72 are permitted to rotate open until the suction side 72S of the variable vanes 72*a* comes into hard contact with the contoured stop 130. The hard contact provides a more effective sealing surface that is independent of radial thermal mismatch. The hard contact stops motion of the variable vanes 72*a* and limits the magnitude of opening to a desired value. When the variable vanes 72*a* move to the closed position, the throat 120*b* becomes the limiting leak path and magnitude of the leak is greatest. The increase in swirl exiting the more closed turbine nozzle, however, at least partially offsets the increased leakage for a manageable performance impact. The turbine nozzle focuses on the actions of the vanes in which the adjacent vanes create a nozzle to accelerate flow and the throat is where the acceleration peaks. By reducing the performance impact due to leakage, the effective performance is increased when the variable area turbine system 100 is in the open position 120*a*. The closed 120*b* performance is not otherwise significantly affected such that the overall performance is increased due to the sealing effect.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason, the appended claims should be studied to determine true scope and content.

What is claimed is:

1. A vane ring for a gas turbine engine, comprising:

an outer static flowpath wall defined around an axis;

an inner static flowpath wall defined around the axis;

a multiple of variable vanes that extend between the outer static flowpath wall and the inner static flowpath wall, a segment of the outer static flowpath wall and the inner static flowpath wall extending between each of the multiple of variable vanes, each of the multiple of variable vanes pivotable about a respective longitudinal axis; and a multiple of airfoil shaped contoured stops that extend radially inwardly from the segment of the outer static flowpath wall or radially outwardly from the segment of the inner static flowpath wall, each one of the multiple of contoured stops located adjacent to each of the multiple of variable vanes to seal with each respective one of the multiple of variable vanes when the respective variable vane is pivoted about the longitudinal axis to a first position which provides a hard contact therewith.

2. The vane ring as recited in claim 1, wherein the first position is an open condition for the vane ring.

3. The vane ring as recited in claim 1, further comprising a multiple of non-pivotable vanes that alternate with the multiple of variable vanes.

4. The vane ring as recited in claim 1, wherein each of the multiple of contoured stops extend for a chord length between 20%-40% of a chord length of each of the multiple of variable vanes from a trailing edge thereof.

5. The vane ring as recited in claim 1, wherein each of the multiple of contoured stops extend for a height of between 2%-7% of a span of each of the multiple of variable vanes.

6. The vane ring as recited in claim 5, wherein each of the multiple of contoured stops are blended into at least one of the outer static flowpath wall and the inner static flowpath wall.

7. The vane ring as recited in claim 6, wherein the contoured stops define a contact surface for contacting a variable vane in the first position, and wherein the contoured stops blend back to the segment in a direction away from the variable vane.

8. A variable area turbine for a gas turbine engine, comprising:

a static flowpath wall defined around an axis;

a first variable vane that extends from the static flowpath wall, the first variable vane pivotable about a longitudinal axis; and an airfoil shaped contoured stop that extends from the static flowpath wall, the contoured stop being of an airfoil shape such that a first side of the contoured stop matches a portion of a first side of the first variable vane along a chord length when the first variable vane is pivoted about the longitudinal axis to a first position which provides a hard contact therewith, wherein the contoured stop is of a chord length between 20%-40% of a chord length of the first variable vane from a trailing edge thereof.

9. The variable area turbine as recited in claim 8, wherein the static flowpath wall is at least one of an outer static flowpath wall and an inner static flowpath wall of a turbine vane ring.

10. The variable area turbine as recited in claim 8, wherein the contoured stop extends for a height of between 2%-7% of a span of each of the multiple of variable vanes.

11. The variable area turbine as recited in claim 8, wherein the first side of the contoured stop is of a convex shape and the first side of the vane is a concave shape.

12. The variable area turbine as recited in claim 8, wherein the first side of the contoured stop is of a concave shape and the first side of the vane is a convex shape.

13. The variable area turbine as recited in claim 8, further comprising a second vane that extends from the static flowpath wall, the first variable vane pivotable about the longitudinal axis with respect to the second vane to define a throat therebetween.

14. The vane ring as recited in claim 8, wherein the contoured stop defines a stop surface for contact with an adjacent variable vane in the first position, and wherein the contoured stop blends back to the flowpath wall in a direction away from the adjacent variable vane.

15. A method of operating a variable area turbine, comprising:

rotating a variable vane about a longitudinal axis until a side of the variable vane hard contacts an airfoil shaped contoured stop that extends from a static flowpath wall radially along the variable vane, the airfoil shaped contoured stop of a shape that matches at least a portion of the side of the variable vane providing a sealing surface therewith.

16. The method as recited in claim 15, wherein the contoured stop is of a chord length between 20%-40% of a chord length of the variable vane from a trailing edge thereof.

17. The method as recited in claim 16, wherein rotating the vane comprises rotating the vane such that a convex side of the vane seals with a concave side of the contoured stop.

18. The method as recited in claim 16, wherein rotating the vane comprises rotating the vane such that a concave side of the vane seals with a convex side of the contoured stop.

19. The method as recited in claim 16, wherein the hard contact is a mechanical contact.

20. The method as recited in claim 15, wherein the sealing surface is a chord length between 20%-40% of a chord length the variable vane.

21. The method as recited in claim 20, wherein the sealing surface extends from the static flowpath wall for a height of between 2%-7% of a span of each of the vanes.

22. The method as recited in claim 15, wherein the contoured stop defines a stop surface for contact with an adjacent variable vane in the first position, and wherein the contoured stop blends back to the flowpath wall in a direction away from the adjacent variable vane.

23. The method as recited in claim 15, wherein the hard contact provides a sealing surface that is independent of radial thermal mismatch.

24. The method as recited in claim 15, wherein the hard contact limits the magnitude of opening to a desired value.

* * * * *